US010645997B2

(12) United States Patent
Chiang et al.

(10) Patent No.: US 10,645,997 B2
(45) Date of Patent: May 12, 2020

(54) SHOE CAPABLE OF CHANGING SHOE TYPES

(71) Applicant: Tsung-Ju Chiang, Taipei (TW)

(72) Inventors: Tsung-Ju Chiang, Taipei (TW); Ya-Fen Huang, Taipei (TW)

(73) Assignee: Tsung-Ju Chiang, Taipei (TW)

( * ) Notice: Subject to any disclaimer, the term of this patent is extended or adjusted under 35 U.S.C. 154(b) by 276 days.

(21) Appl. No.: 15/533,655

(22) PCT Filed: May 24, 2016

(86) PCT No.: PCT/CN2016/083165
§ 371 (c)(1),
(2) Date: Jun. 7, 2017

(87) PCT Pub. No.: WO2017/161671
PCT Pub. Date: Sep. 28, 2017

(65) Prior Publication Data

US 2018/0049516 A1 Feb. 22, 2018

(30) Foreign Application Priority Data

Mar. 21, 2016 (CN) ..... 2016 1 0159912

(51) Int. Cl.
*A43B 21/433* (2006.01)
*A43B 3/24* (2006.01)
*A43B 21/42* (2006.01)
*A43B 13/16* (2006.01)

(52) U.S. Cl.
CPC ..... *A43B 21/433* (2013.01); *A43B 3/246* (2013.01); *A43B 13/16* (2013.01); *A43B 21/42* (2013.01)

(58) Field of Classification Search
CPC ..... A43B 21/433; A43B 3/24; A43B 3/244; A43B 3/242; A43B 3/248; A43B 21/36; A43B 21/48; A43B 21/50; A43B 21/51; A43B 3/246; A43B 21/42
USPC ..... 36/39, 36 R, 41, 42
See application file for complete search history.

(56) References Cited

U.S. PATENT DOCUMENTS

| | | | | |
|---|---|---|---|---|
| 5,309,651 A * | 5/1994 | Handel | ..... | A43B 21/433 36/100 |
| 2014/0208620 A1* | 7/2014 | Damodar | ..... | A43B 3/246 36/25 R |
| 2017/0042276 A1* | 2/2017 | Alan | ..... | A43B 21/433 |

FOREIGN PATENT DOCUMENTS

| | | |
|---|---|---|
| CN | 201929124 U | 8/2011 |
| CN | 102793338 A | 11/2012 |
| CN | 103610271 A | 3/2014 |
| CN | 203969374 U | 12/2014 |
| CN | 205585433 U | 9/2016 |

(Continued)

*Primary Examiner* — Anna K Kinsaul
*Assistant Examiner* — F Griffin Hall
(74) *Attorney, Agent, or Firm* — CKC & Partners Co., LLC

(57) ABSTRACT

A shoe capable of changing shoe types includes a shoe body, a shoe loading-plate disposed on one side of the shoe body, and having a front bracket and a rear bracket pivotally connected to the front bracket and having a pivoting base fixed on a side of the rear bracket opposite to the shoe body, a shoe heel pivotally connected to the pivoting base, a linking member pivotally connected to the front bracket and the shoe heel, and a shoe sole layer covering the shoe loading-plate and the linking member. The shoe sole layer is formed with an opening for receiving the shoe heel.

17 Claims, 15 Drawing Sheets

(56) References Cited

FOREIGN PATENT DOCUMENTS

GB 2483900 A 3/2012

* cited by examiner

SHOE CAPABLE OF CHANGING SHOE TYPES

RELATED APPLICATIONS

This application is a continuation of International application No. PCT/CN2016/083165, filed on May 24, 2016 which claims the benefits of priority of CN application No. 201610159912.2, filed on Mar. 21, 2016, the content of which are incorporated herein by reference.

BACKGROUND

Field of Invention

The present disclosure relates to a shoe, more particularly, to a shoe capable of changing shoe types.

Description of Related Art

In order to be polite or to seem taller, a lady normally wears high-heel shoes when going out, however, as wearing high-heel shoes for a long time, the feet of the lady may contract edema or a sprained ankle, so that not only the lady is easy to fall down, but also ankle injury may be caused to the lady thereby affecting the health of the lady and providing uncomfortable experience. Therefore, a user may change the high-heel shoes with another pair of heel shoes with lower heel, or carry a pair of flat shoes to exchange with the high-heel shoes alternatively.

Although a product design of high-heel shoes capable of removing a shoe heel thereof is available in the market, however, since a shoe heel of the high-heel shoes is inevitably stuck with mud or dirt after the shoe heel being stepped on the ground, thus, when removing the shoe heel, the shoe heel must be contacted by hands thereby getting the hand dirty.

Therefore, ways to provide a solution to effectively solve the aforementioned inconvenience and shortages and to increase the competitiveness of industries will be seriously concerned.

SUMMARY

An objection of the disclosure is to provide a shoe capable of changing shoe types, which can solve the problem mentioned above, that is, the possibilities of the shoe heel of the shoe being pulled by hands to cause the hand to become dirty can be reduced.

According to one embodiment, a shoe capable of changing shoe types includes a shoe body, a shoe loading-plate, a shoe heel, a linking member and a shoe sole layer. The shoe loading-plate is disposed on one side of the shoe body, and the shoe loading-plate includes a front bracket and a rear bracket pivotally connected to the front bracket, and one side of the rear bracket opposite to the shoe body is provided with a pivoting base. One end of the shoe heel is pivotally connected to the pivoting base. The linking member is disposed on the side of the rear bracket opposite to the shoe body, and pivotally connected to the front bracket and the shoe heel. The shoe sole layer covers the shoe loading-plate and the linking member, is provided with a receiving recess formed on one surface of the shoe sole layer opposite to the shoe body for accommodating the shoe heel.

Thus, when a user wears the shoe of the embodiment, the user's foot including a heel part and a toe part is substantially placed on the shoe loading-plate. Thus, once the user lifts the heel part to bend the toe part on the shoe loading-plate, by folding the shoe loading-plate of the embodiment, while the front bracket and the rear bracket are rotated at the same time, the shoe heel hidden in the shoe can be simultaneously rotated out of the shoe. Thus, the shoe heel does not need to be pulled manually by user's hand so as to reduce the possibilities of the hand of getting dirty.

In one or more embodiments of the present disclosure, the shoe further includes a resilient element. The resilient element is connected to the shoe loading-plate and the shoe heel, and is used to move the shoe heel to rotate in or out of the receiving recess.

In one or more embodiments of the present disclosure, the shoe further includes a latch mechanism. The latch mechanism is connected to at least one of the shoe heel and the pivoting base, and is used to lock the shoe heel in and out of the receiving recess.

In one or more embodiments of the present disclosure, the latch mechanism includes a stopper, a spring and an operation portion. The stopper is slidably disposed on the shoe heel. The spring is connected to the stopper and the shoe heel, is used to force the stopper back to an original position of the stopper. The operation portion is connected to the stopper, and exposed outwards from the shoe through the receiving recess. Thus, when the stopper abuts against the pivoting base, the pivoting base stops the shoe heel from rotating, and when the operation portion moves the stopper away from the pivoting base, the shoe heel is free to rotate.

In one or more embodiments of the present disclosure, one surface of the pivoting base is formed with an inner cavity, the latch mechanism further includes an elastic rib. The elastic rib is monolithically formed on the one end of the shoe heel. Thus, when the elastic rib is temporarily deformed to be moved out of the inner cavity, an outer surface of the pivoting base abuts against the elastic rib for stopping the shoe heel from rotating in a first direction, when the elastic rib is temporarily deformed to be moved into the inner cavity, an inner surface of the inner cavity abuts against the elastic rib for stopping the shoe heel from rotating in a second direction opposite to the first direction.

In one or more embodiments of the present disclosure, the latch mechanism includes a stopper, a spring and an operation portion. The stopper is slidably disposed on the pivoting base. The spring is connected to the stopper and the shoe heel, and is used to force the stopper back to an original position of the stopper. The operation portion is connected to the stopper, and exposed outwards from the shoe through one side of the shoe sole layer adjacent to the rear bracket. Thus, when the stopper abuts against the shoe heel, the stopper stops the shoe heel from rotating. When the operation portion moves the stopper away from the shoe heel, the shoe heel is free to rotate.

In one or more embodiments of the present disclosure, the one end of the shoe heel is formed with a concave trench, and the latch mechanism further includes an elastic rib. The elastic rib is monolithically formed on the one end of the pivoting base. Thus, when the elastic rib is temporarily deformed to be moved to an outer surface of the concave trench from the concave trench, the elastic rib abuts against the one end of the shoe heel for stopping the shoe heel from rotating in a first direction. When the elastic rib is temporarily deformed to be moved into the concave trench, an inner surface of the concave trench abuts against the elastic rib for stopping the shoe heel from rotating in a second direction opposite to the first direction.

In one or more embodiments of the present disclosure, another end of the shoe heel is a free end, and the free end of the shoe heel is in physical contact with the shoe sole layer in the receiving recess.

In one or more embodiments of the present disclosure, the rear bracket is able to rotate in relation to the front bracket in accordance with a first pivot, the shoe heel is able to rotate in relation to the rear bracket in accordance with a second pivot, one end of the linking member is able to rotate in relation to the front bracket in accordance with a third pivot, and the end of the linking member is able to rotate in relation to the shoe heel in accordance with a fourth pivot. The first pivot, the second pivot, the third pivot and the fourth pivot are parallel one another, and the fourth pivot is located between the second pivot and the rear bracket.

According to one embodiment, a shoe capable of changing shoe types includes a shoe body, a shoe sole layer, a linkage assembly and a linking member. The shoe sole layer is formed with a receiving recess on one surface of the shoe sole layer opposite to the shoe body. The linkage assembly is disposed between the shoe body and the shoe sole layer. The linkage assembly includes a front bracket, a rear bracket, a support and a linking member. The front bracket is pivotally connected to the rear bracket and the linking member, and the support is disposed in the receiving recess, and one end of the support is pivotally connected to the linking member and the rear bracket. When the rear bracket is rotated to narrow an included angle defined between the front bracket and the rear bracket, the support member is moved out of the receiving recess by the linkage of the rear bracket and the linking member.

In one or more embodiments of the present disclosure, the shoe further includes a resilient element. The resilient element is connected to the rear bracket and the support, and is used to move the support to rotate in or out of the receiving recess.

In one or more embodiments of the present disclosure, the shoe further includes a latch mechanism. The latch mechanism is connected to at least one of the support and the rear bracket, and is used to lock the support in and out of the receiving recess.

In one or more embodiments of the present disclosure, the latch mechanism includes a stopper, a spring and an operation portion. The stopper is slidably disposed on the support. The spring is connected to the stopper and the support, and is used to force the stopper back to an original position of the stopper. The operation portion is connected to the stopper, and exposed outwards from the shoe through the receiving recess. When the stopper abuts against the rear bracket, the rear bracket stops the support from rotating. When the operation portion moves the stopper away from the rear bracket, the support is free to rotate.

In one or more embodiments of the present disclosure, one surface of the rear bracket opposite to the shoe body further includes an inner cavity. The latch mechanism further includes an elastic rib. The elastic rib is monolithically formed on the one end of the support. When the elastic rib is temporarily deformed to be moved out of the inner cavity, the rear bracket abuts against the elastic rib for stopping the support from rotating in a first direction. When the elastic rib is temporarily deformed to be moved into the inner cavity, an inner surface of the inner cavity abuts against the elastic rib for stopping the support from rotating in a second direction opposite to the first direction.

In one or more embodiments of the present disclosure, the latch mechanism includes a stopper, a spring and an operation portion. The stopper is slidably disposed on one side of the rear bracket opposite to the shoe body. The spring is connected to the stopper and the rear bracket, and is used to force the stopper back to an original position of the stopper. The operation portion is connected to the stopper, and exposed outwards from the shoe through one side of the shoe sole layer adjacent to the rear bracket. When the stopper abuts against the support, the stopper stops the support from rotating. When the operation portion moves the stopper away from the support, the support is free to rotate.

In one or more embodiments of the present disclosure, the one end of the support is formed with a concave trench, and the latch mechanism further includes an elastic rib. The elastic rib is monolithically formed on one side of the rear bracket opposite to the shoe body. When the elastic rib is temporarily deformed to be moved to an outer surface of the concave trench from the concave trench, the elastic rib abuts against the one end of the support for stopping the support from rotating in a first direction. When the elastic rib is temporarily deformed to be moved into the concave trench, an inner surface of the concave trench abuts against the elastic rib for stopping the support from rotating in a second direction opposite to the first direction.

In one or more embodiments of the present disclosure, another end of the support is a free end, and the free end of the support is in physical contact with the shoe sole layer in the receiving recess.

In one or more embodiments of the present disclosure, the support is a shoe heel, an auxiliary wheel or a shoe spike.

In one or more embodiments of the present disclosure, the rear bracket is able to rotate in relation to the front bracket in accordance with a first pivot, the support is able to rotate in relation to the rear bracket in accordance with a second pivot, the linking member is able to rotate in relation to the front bracket in accordance with a third pivot, and the linking member is able to rotate in relation to the support in accordance with a fourth pivot. The first pivot, the second pivot, the third pivot and the fourth pivot are parallel one another, and the fourth pivot is located between the second pivot and the rear bracket.

Compared with the prior art, the disclosure is provided with following beneficial effects: a shoe capable of changing shoe types of the disclosure is able to reduce the possibilities that the shoe heel is pulled manually by user's hand so as to reduce the possibilities of the hand of getting dirty.

It is to be understood that both the foregoing general description and the following detailed description are by examples, and are intended to provide further explanation of the disclosure as claimed.

BRIEF DESCRIPTION OF THE DRAWINGS

In order to make the aforesaid as well as other aspects, features, advantages, and embodiments of the present disclosure more apparent, the accompanying drawings are described as follows.

DESCRIPTION OF THE EMBODIMENTS

Figure 1:
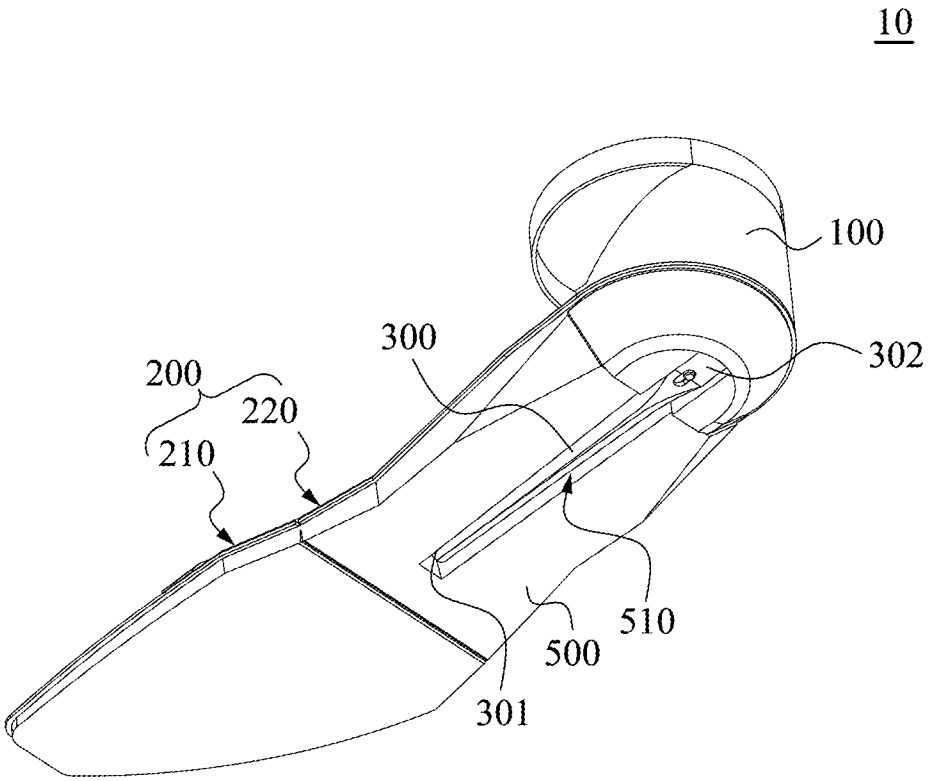
FIG. 1 depicts a schematic view of a shoe capable of changing shoe types according to one embodiment of the disclosure.

Hereinafter, the plural embodiments of the present disclosure will be disclosed by way of example, and a number of practical details will be described in the following description for clarity of explanation. It will be understood by those skilled in the art, however, that these practical details are not necessary in the presently described embodiments, and are not intended to limit the present disclosure. In addition, for the sake of simplicity of schema, some conventionally preferred structures and elements will be schematically illustrated in the drawings. In addition, in order to facilitate the reader to watch, the size of the elements in the figure is not according to the actual proportion of drawings.

Figure 2A:
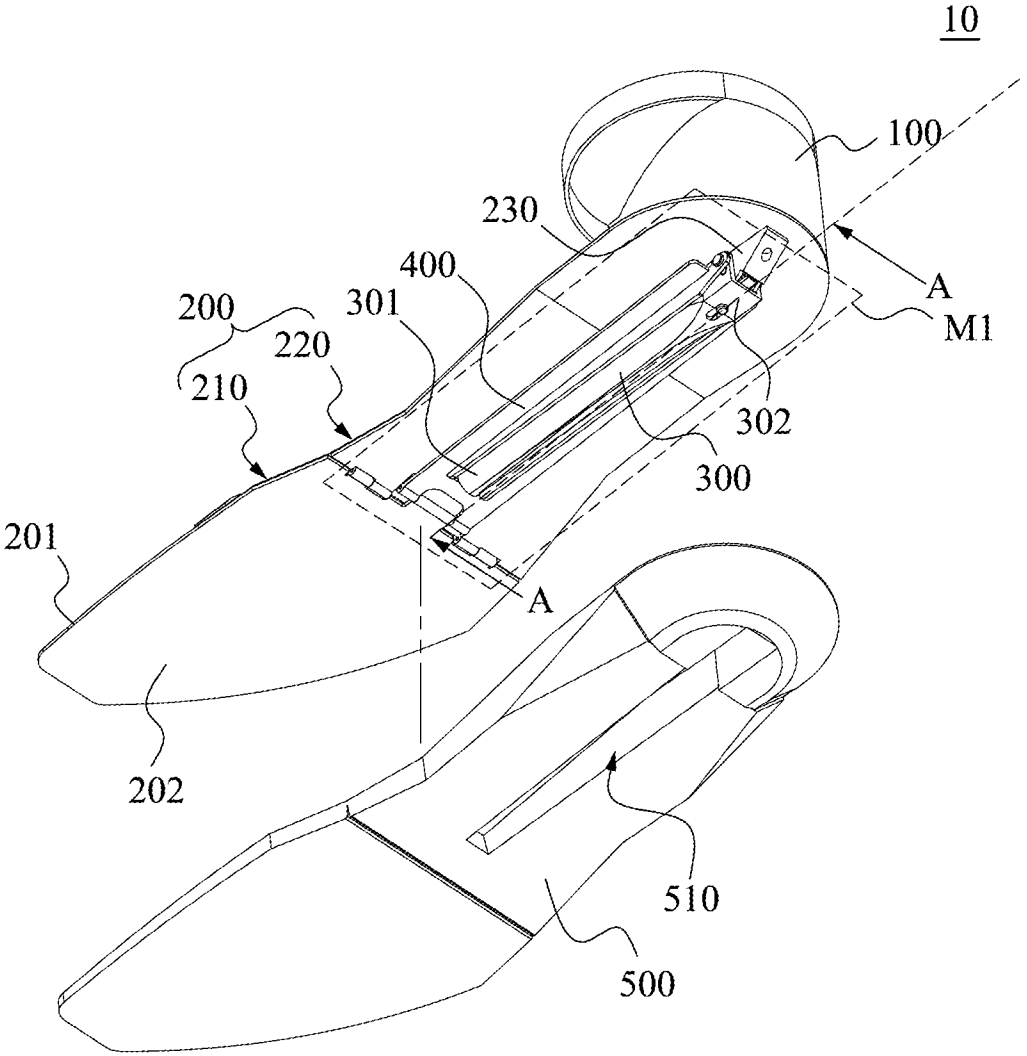
FIG. 2A depicts a partial exploded view of FIG. 1.
Figure 2B:
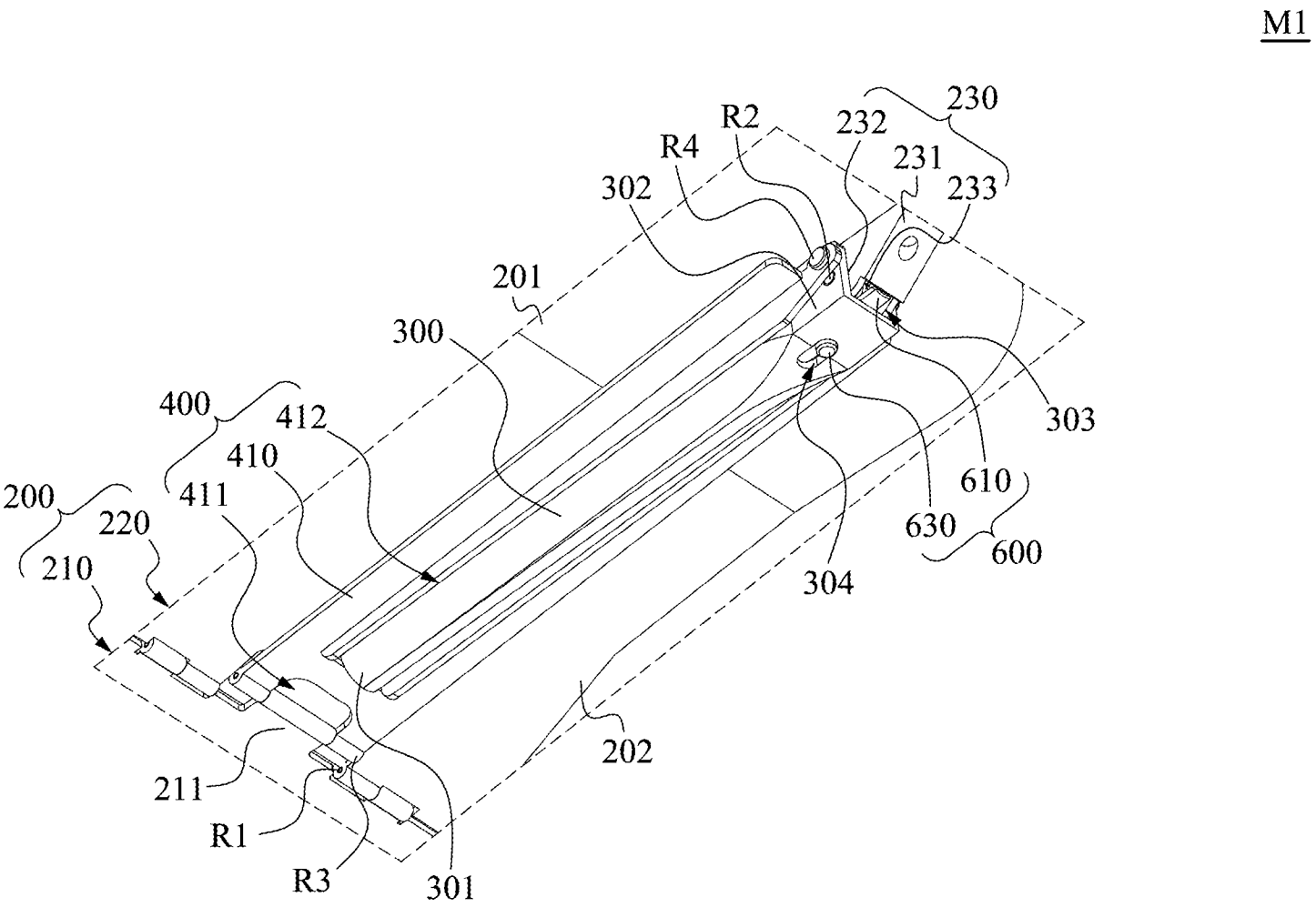
FIG. 2B depicts a partially enlarged view of an area M1 of FIG. 2A.

FIG. 1 depicts a schematic view of a shoe 10 capable of changing shoe types according to one embodiment of the disclosure, FIG. 2A depicts a partial exploded view of FIG. 1, and FIG. 2B is an partially enlarged view of an area M1 of FIG. 2A. As shown in FIG. 1 to FIG. 2B, in the embodiment, the shoe 10 capable of changing shoe types includes a shoe body 100, a shoe loading-plate 200, a shoe heel 300, a linking member 400 and a shoe sole layer 500. The shoe loading-plate 200 is disposed on one side of the shoe body 100. The shoe heel 300, the linking member 400 and the shoe sole layer 500 are collectively located on one side of the shoe loading-plate 200 opposite to the shoe body 100. The shoe loading-plate 200 includes a front bracket 210 and a rear bracket 220. The rear bracket 220 is pivotally connected to the front bracket 210. One side of the rear bracket 220 opposite to the shoe body 100 is provided with a pivoting base 230. One end of the shoe heel 300 is pivotally connected to the pivoting base 230 of the rear bracket 220. Two opposite ends of the linking member 400 are respectively pivotally connected to the front bracket 210 and the shoe heel 300. The shoe sole layer 500 covers the shoe loading-plate 200 and the linking member 400, and the shoe sole layer 500 is formed with a receiving recess 510. The receiving recess 510 is disposed on one surface of the shoe sole layer 500 opposite to the shoe body 100 for partially accommodating and exposing the shoe heel 300 outwards from the shoe 10, or even fully accommodating and exposing the whole part of shoe heel 300 outwards from the shoe 10.

Since the front bracket 210, the rear bracket 220 (including the pivoting base 230), the shoe heel 300 and the linking member 400 are pivotally connected one another so as to collectively form a linkage assembly (e.g., four-bar linkage assembly), thus, when rotating the front bracket 210 or the rear bracket 220, by the linkage of the rear bracket 220 and the linking member 400, the shoe heel 300 can be simultaneously rotated into or out of the receiving recess 510 so as to transform the shoe to a flat shoe model or a heel shoe model easily. Thus, the shoe heel does not need to be pulled manually by user's hand so as to reduce the possibilities of the hand getting dirty.

Specifically, as shown in FIG. 2A and FIG. 2B, the shoe loading-plate 200 is provided with an upper side surface 201 and a lower side surface 202 which are opposite to each other. The shoe body 100 is disposed on the upper side surface 201 of the shoe loading-plate 200. The shoe heel 300, the linking member 400 and the shoe sole layer 500 are collectively disposed on the lower side surface 202 of the shoe loading-plate 200. Since the rear bracket 220 is pivotally connected to one side of the front bracket 210, the rear bracket 220 is able to rotate in relation to the front bracket 210 in accordance with a first pivot R1. The shoe heel 300 is shaped in an elongated shape, and the shoe heel 300 includes a first end 301 and a second end 302 which are opposite to each other in which the first end 301 of the shoe heel 300 is a free end, and the second end 302 of the shoe heel 300 is pivotally connected to one side of the rear bracket 220 opposite to the front bracket 210 so that the shoe heel 300 is able to rotate in relation to the rear bracket 220 in accordance with a second pivot R2. Two opposite ends of the linking member 400 are pivotally connected to the front bracket 210 and the shoe heel 300 so that the linking member 400 is able to rotate in relation to the front bracket 210 in accordance with a third pivot R3, and the linking member 400 is able to rotate in relation to the shoe heel 300 in accordance with a fourth pivot R4. It is noted, the axis directions of the first pivot R1, the second pivot R2, the third pivot R3 and the fourth pivot R4 are parallel one another, but are not coaxial one another. Furthermore, the fourth pivot R4 is located between the second pivot R2 and the rear bracket 220.

Figure 3:
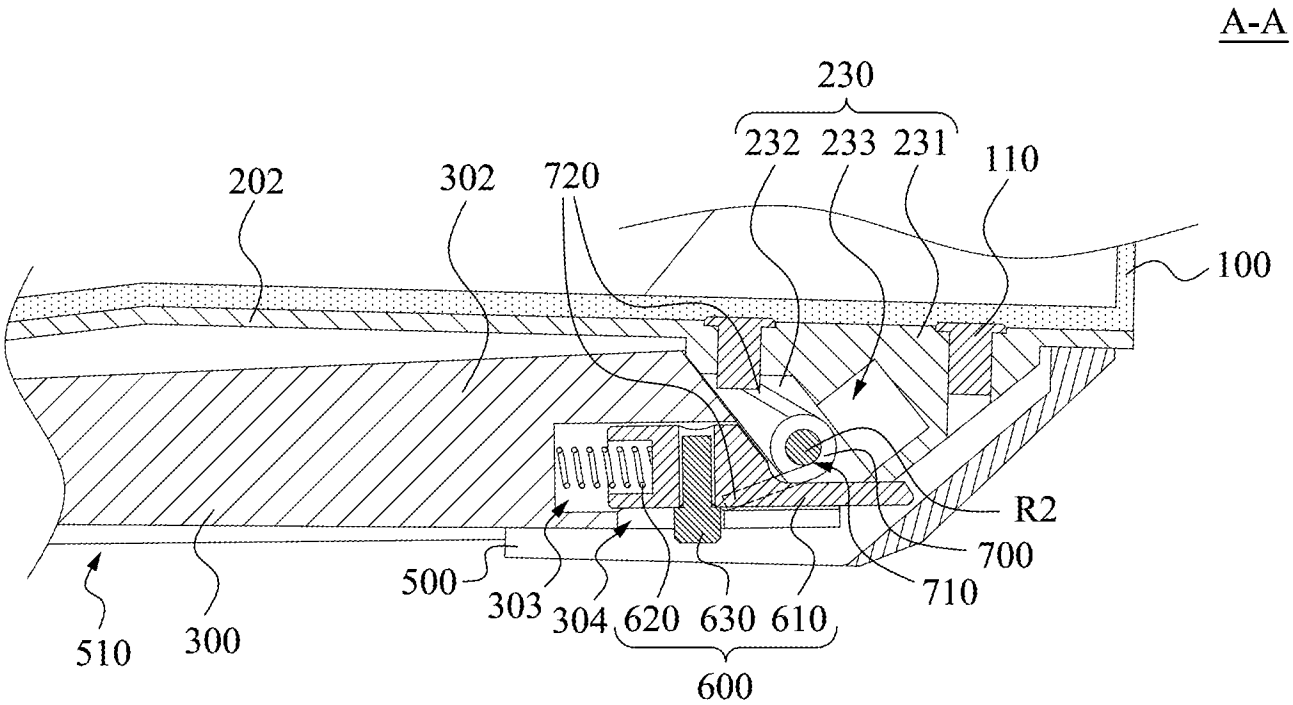
FIG. 3 depicts a partial cross-sectional view of FIG. 2A taken along A-A.

FIG. 3 depicts a partial cross-sectional view of FIG. 2A taken along A-A. As shown in FIG. 2B and FIG. 3, in the embodiment, more particular, the pivoting base 230 includes a base body 231, two extending wings 232 and an inner cavity 233. The base body 231 is disposed on one surface of the rear bracket 220 opposite to the shoe body 100, and extends into a depression recess 303 formed at the second end 302 of the shoe heel 300. The extending wings 232 are spaced with each other so that the second end 302 of the shoe heel 300 is pivotally connected to the extending wings 232 through the second pivot R2. The inner cavity 233 is formed between the extending wings 232 in the base body 231.

As shown in FIG. 2B, the linking member 400 includes an elongated slab 410, a first opening 411 and a second opening 412. The first opening 411 and the second opening 412 are respectively formed on two opposite ends of the elongated slab 410. The front bracket 210 is partly formed with a lug 211 protruding from one side of the front bracket 210 and extending into the first opening 411, and the end of the elongated slab 410 having the first opening 411 is pivotally connected to the lug 211 through the third pivot R3. The second opening 412 is in an elongated shape, and is formed on one end of the elongated slab 410 opposite to the third pivot R3. The second opening 412 receives the shoe heel 300 and the pivoting base 230, and the other end of the elongated slab 410 having the second opening 412 is pivotally connected to the second end 302 of the shoe heel 300 through the fourth pivot R4. It is noted, the fourth pivot R4 is not connected to the pivoting base 230.

In addition, as shown in FIG. 3, the shoe 10 capable of changing shoe types further includes a latch mechanism 600. The latch mechanism 600 is installed on the shoe heel 300, and is able to slidably abut the pivoting base 230 for properly stopping the shoe heel 300 from rotating so as to fix the shoe heel 300. More particular, the latch mechanism 600 includes a first stopper 610, a first spring 620 and a first operation portion 630. The first stopper 610 is slidably disposed on the shoe heel 300, for example, the first stopper 610 is disposed within the depression recess 303 formed at the second end 302 of the shoe heel 300, and one end of the first stopper 610 extends outwards from the depression recess 303. The first spring 620 is connected to the first stopper 610 and the shoe heel 300, and is able to force the first stopper 610 back to an original position of the first stopper 610. For example, the first spring 620 is disposed within the depression recess 303, and one end of the first spring 620 abuts against the inner wall of the depression recess 303, and the opposite end of the first spring 620 abuts against the first stopper 610. The first operation portion 630 is connected to the first stopper 610, and is able to be moved along with the first stopper 610. The first operation portion 630 is exposed outwards from the shoe 10 through the shoe sole layer 500. For example, the first operation portion 630 is a push button or a lever, and the first operation portion 630 is exposed outwards from a break 304 of the shoe heel 300, and is exposed outwards from the shoe through the receiving recess 510. Thus, when a user pushes the first operation portion 630, the first stopper 610 is moved along with the first operation portion 630. However, the disclosure is not limited thereto, in another option of the disclosure, as long as the first stopper 610 can be moved along with the first operation portion 630, the first operation portion 630 also may be exposed outwards through another break of the shoe sole layer and the show body.

Thus, when the first spring 620 forces the first stopper 610 back to the original (FIG. 3) so that the first stopper 610 abuts against an outer surface of the pivoting base 230, the pivoting base 230 stops the rotation of the shoe heel 300 so as to transform the shoe to a flat shoe model. Conversely, when the first operation portion 630 compresses the first spring 620 to move the first stopper 610 away from the pivoting base 230, the latch mechanism 600 releases the confinement of the shoe heel 300, that is, since the pivoting base 230 does not stop the rotation of the shoe heel 300, the shoe heel 300 is free to rotate out of the receiving recess 510 so as to transform the shoe to a heel shoe model.

Furthermore, as shown in FIG. 3, the shoe 10 capable of changing shoe types further includes a resilient element such as a torsion spring 700. The torsion spring 700 is disposed on one side of the shoe loading-plate 200 opposite to the shoe body 100, and two opposite ends of the torsion spring 700 respectively connected to the shoe loading-plate 200 (e.g., the pivoting base 230) and the shoe heel 300. When the shoe heel 300 rotated into the receiving recess 510 is temporarily confined by the latch mechanism 600, the torsion spring 700 is compressed to store a recovering force. More specifically, the torsion spring 700 is formed with a hollow passage 710 which the second pivot R2 is able to go through. Two opposite elastic arms 720 of the torsion spring 700 are respectively connected to the loading-plate 200 and the shoe heel 300. However, the disclosure is not limited thereto, the torsion spring 700 also can be replaced by another resilient element such as a retractable spring.

Figure 4:
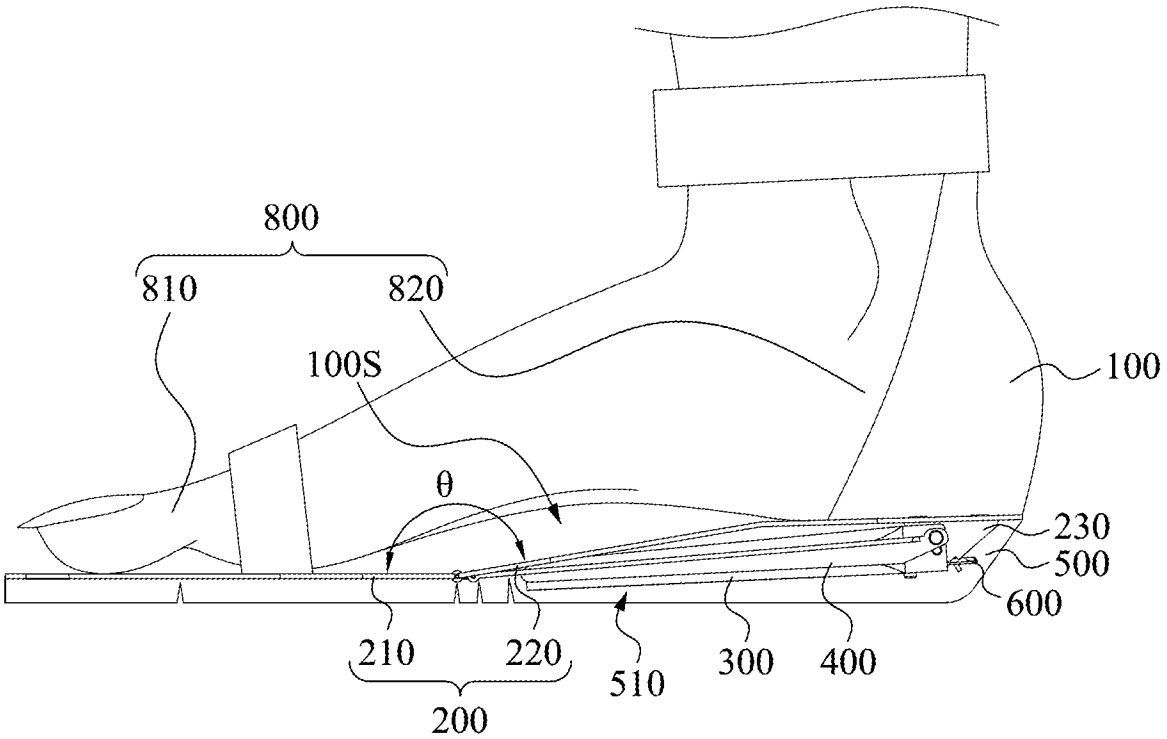
FIG. 4-FIG. 6 depict operational schematic views of the shoe capable of changing shoe types of FIG. 1.
Figure 5:
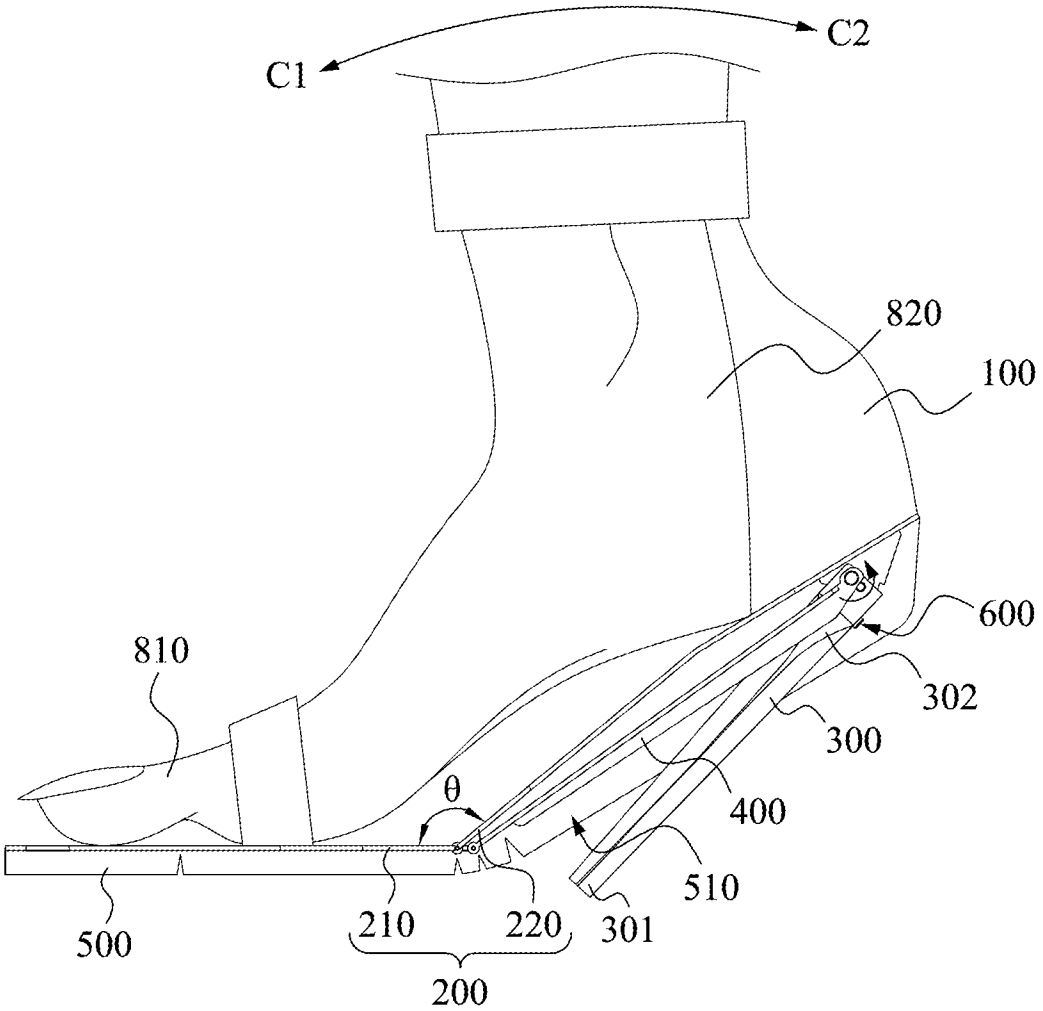
Figure 6:
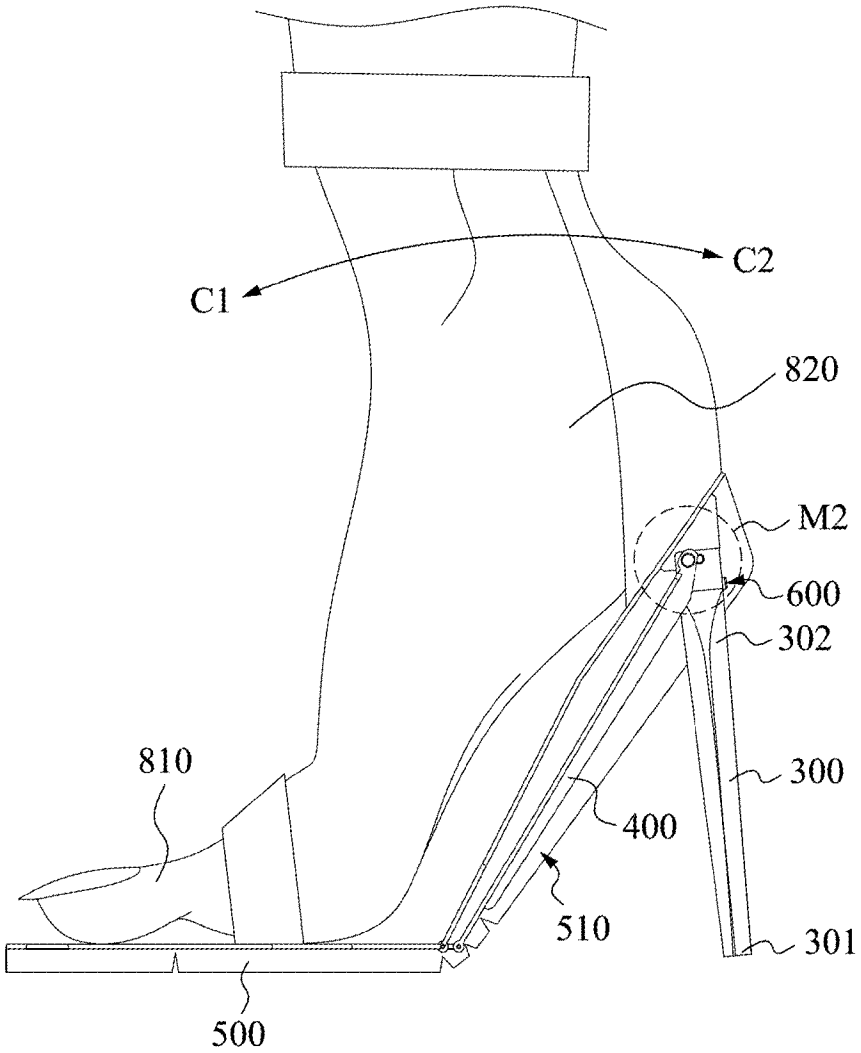

Moreover, FIG. 4-FIG. 6 depict operational schematic views of the shoe 10 capable of changing shoe types of FIG. 1. It is noted, in order to clearly identify the relationship and movement of these aforementioned elements installed inside the shoe, the shoe sole layer 500 of the shoe in FIG. 4-FIG. 6 is hereby partially seen through, thus, the shoe shown in FIG. 4-FIG. 6 is not for disclosing the appearance of the shoe capable of changing shoe types of the disclosure.

In this embodiment, as shown in FIG. 4, the pivoting base 230 is fixed on the rear bracket 220 by fixing members 110 (e.g., a fixing nail, FIG. 3). A space 100S is mutually defined by the shoe body 100 and the loading-plate 200, and the space 100S can receive one foot 800 including a toe part 810 and a heel part 820. The shoe body 100, for example, includes shoe material for covering fully or partially the foot 800 in which the front bracket 210 is used to bear the toe part 810 of the foot 800, and the rear bracket 220 is used to bear the heel part 820 of the foot 800. Be aware that the shoe body in the disclosure can be generally referred to all kind of shoes, and the disclosure is not limited to the pattern shown in the drawings thereof.

Thus, when a user is desired to transform the shoe 10 to the heel shoe model from the flat shoe model, as shown in FIG. 4, the user first manually operate the latch mechanism 600 to release the confinement of the shoe heel 300 in the receiving recess 510, next, as shown in FIG. 5, the user lifts the heel part 820 of the foot 800 to bend the toe part 810 of the foot 800, so that the rear bracket 220 is moved to rotate towards a first rotation direction C1 in relative to the front bracket 210 by the heel part 820 through the shoe body 100 so as to narrow a included angle 9 defined between the front bracket 210 and the rear bracket 220. Thus, by the linkage of the rear bracket 220, both of the linking member 400 and the shoe heel 300 rotate towards the first rotation direction C1 in relative to the front bracket 210 such that the second end 302 of the shoe heel 300 is rotated outwards from the receiving recess 510. Meanwhile, since the recovering force is released from the torsion spring 700, the recovering force can move the shoe heel 300 outwards from the receiving recess 510 to an expected position where the shoe 10 can be supported immediately (FIG. 6). At this moment, the shoe is in the heel shoe model.

Figure 7:
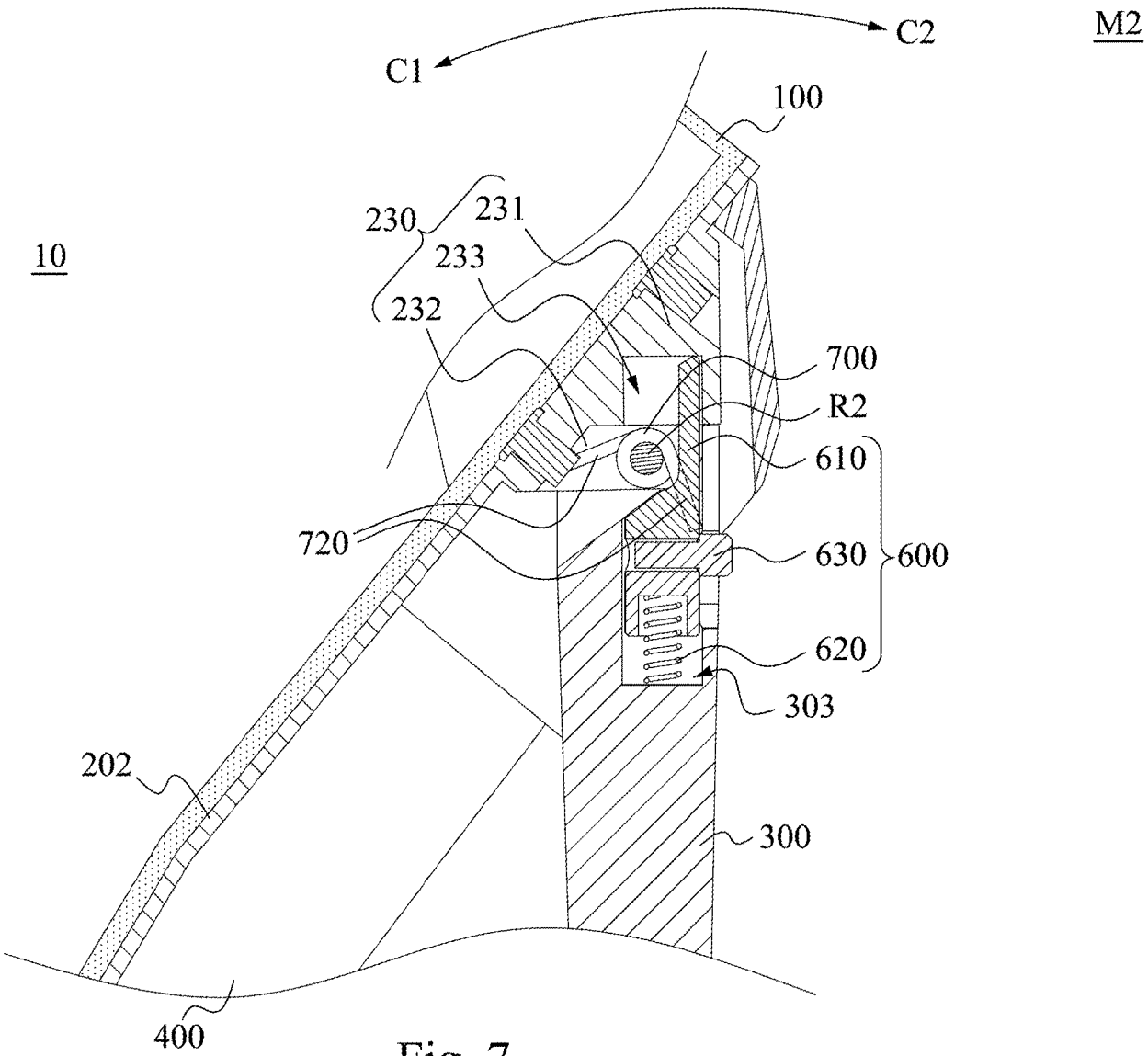
FIG. 7 depicts a partial cross-sectional view of an area M2 of FIG. 6, whose sectional direction is the same as the sectional direction in FIG. 3.

FIG. 7 depicts a partial cross-sectional view of an area M2 of FIG. 6, whose sectional direction is the same as the sectional direction in FIG. 3. As shown in FIG. 7, when the shoe 10 is in the heel shoe model, since the first stopper 610 exactly extends into the inner cavity 233 to abut against an inner surface of the inner cavity 233, the base body 231 and the torque of the torsion spring 700 is stiff enough to resist the first stopper 610 (i.e., shoe heel 300) from rotating towards a second rotation direction C2 so as to keep the shoe 10 in the heel shoe model.

On the contrary, when a user is desired to transform the shoe 10 to the flat shoe model from the heel shoe model, refer to FIG. 4 and FIG. 5 following an order from FIG. 5 to FIG. 4, after the user manually operate the latch mechanism 600 to release the shoe heel 300 confined in the inner cavity 233, next, as shown in FIG. 5, once the user presses the shoe heel 300 with the foot in the shoe 10, the shoe heel 300 is reversely rotated into the receiving recess 510 towards the second rotation direction C2 (FIG. 4). At the same time, as shown in FIG. 3, when the first stopper 610 located at the aforementioned original position to abut an outer surface of the shoe base 231 of the pivoting base 230 overcome the recovering force of the torsion spring 700, the shoe heel 300 is confined in the receiving recess 510, thereby not allowing to rotate out of the receiving recess 510. Thus, the shoe is in the flat shoe model now. At this moment, since the included angle 9 defined between the front bracket 210 and the rear bracket 220 is therefore increased, the loading-plate 200 is getting flat. (FIG. 4)

Furthermore, as shown in FIG. 1, in order to further reduce the possibility of the hand getting dirty, when the shoe 10 is in the flat shoe model, the first end 301 of the shoe heel 300 received in the receiving recess 501 physically contacts with the shoe sole layer 500 so as to reduce the motivation that the shoe heel 300 can be pulled by user's hand.

Figure 8:
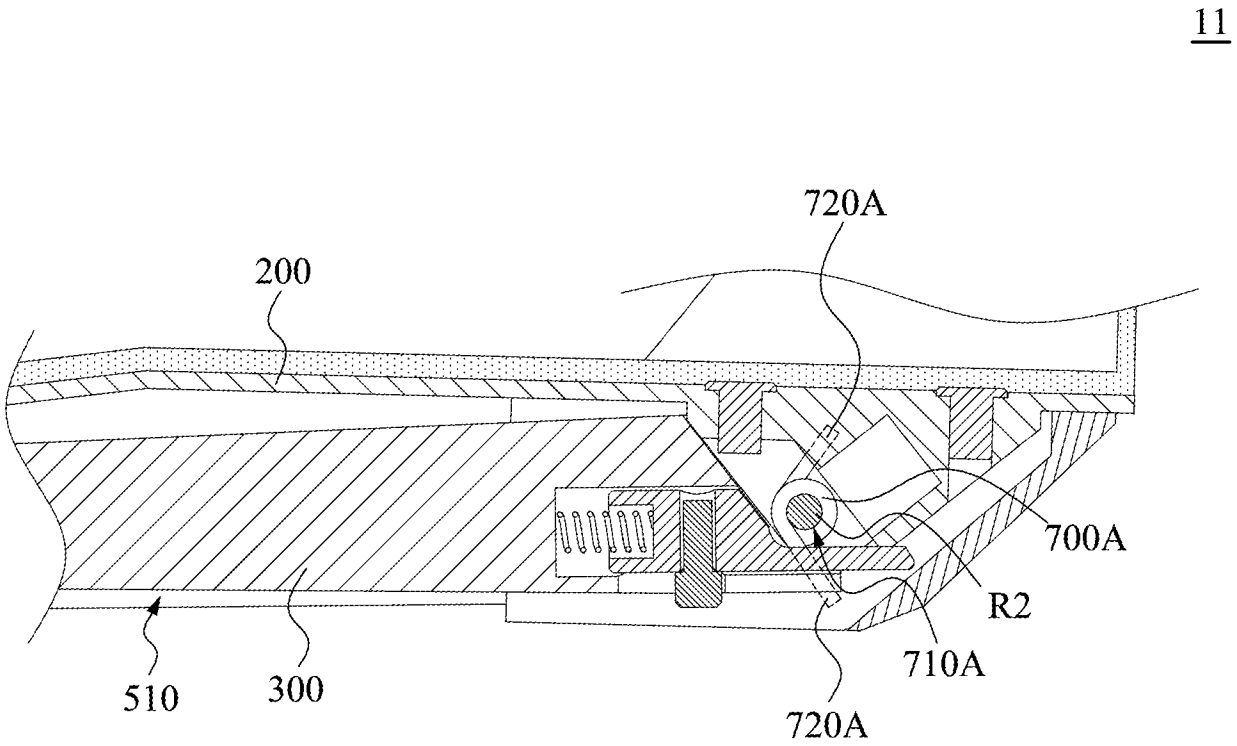
FIG. 8 depicts a cross-sectional view of a shoe capable of changing shoe types according to one embodiment of the disclosure, whose sectional direction is the same as the sectional direction in FIG. 3.

FIG. 8 depicts a cross-sectional view of a shoe 11 capable of changing shoe types according to one embodiment of the disclosure, whose sectional direction is the same as the sectional direction in FIG. 3. The shoe 11 in FIG. 8 and the shoe 10 in FIG. 3 are substantially the same, except that the torsion spring 700 disclosed in FIG. 3 is installed between the shoe heel 300 and the loading-plate 200, that is, the two opposite elastic arms 720 of the torsion spring 700 are collectively extended towards the shoe heel 300 as the shoe heel 300 is confined in the receiving recess 510. Thus, the shoe heel 300 can be moved outwards from the receiving recess 510 automatically by the recovering force of the torsion spring 700. On the other hands, as shown in FIG. 8, a torsion spring 700A of another embodiment is reversely installed between the shoe heel 300 and the loading-plate 200, that is, two opposite elastic arms 720 of the torsion spring 700A are collectively extended along a direction which is opposite to the shoe heel 300 as the shoe heel 300 is confined in the receiving recess 510. More specifically, the torsion spring 700A is formed with a hollow passage 710A which the second pivot R2 is able to go through. The two opposite elastic arms 720A of the torsion spring 700A are respectively connected to the loading-plate 200 and the shoe heel 300. However, the disclosure is not limited thereto, the torsion spring 700A also can be replaced by another resilient element such as a retractable spring.

Thus, after the torsion spring 700A in FIG. 8 is compressed, that is, the two opposite elastic arms 720A of the torsion spring 700A are close to each other so as to store a recovering force. When the torsion spring 700A is released, the recovering force can move the shoe heel 300 to rotate into the receiving recess 510 so that the shoe heel can be hidden in the shoe 11.

Figure 9A:
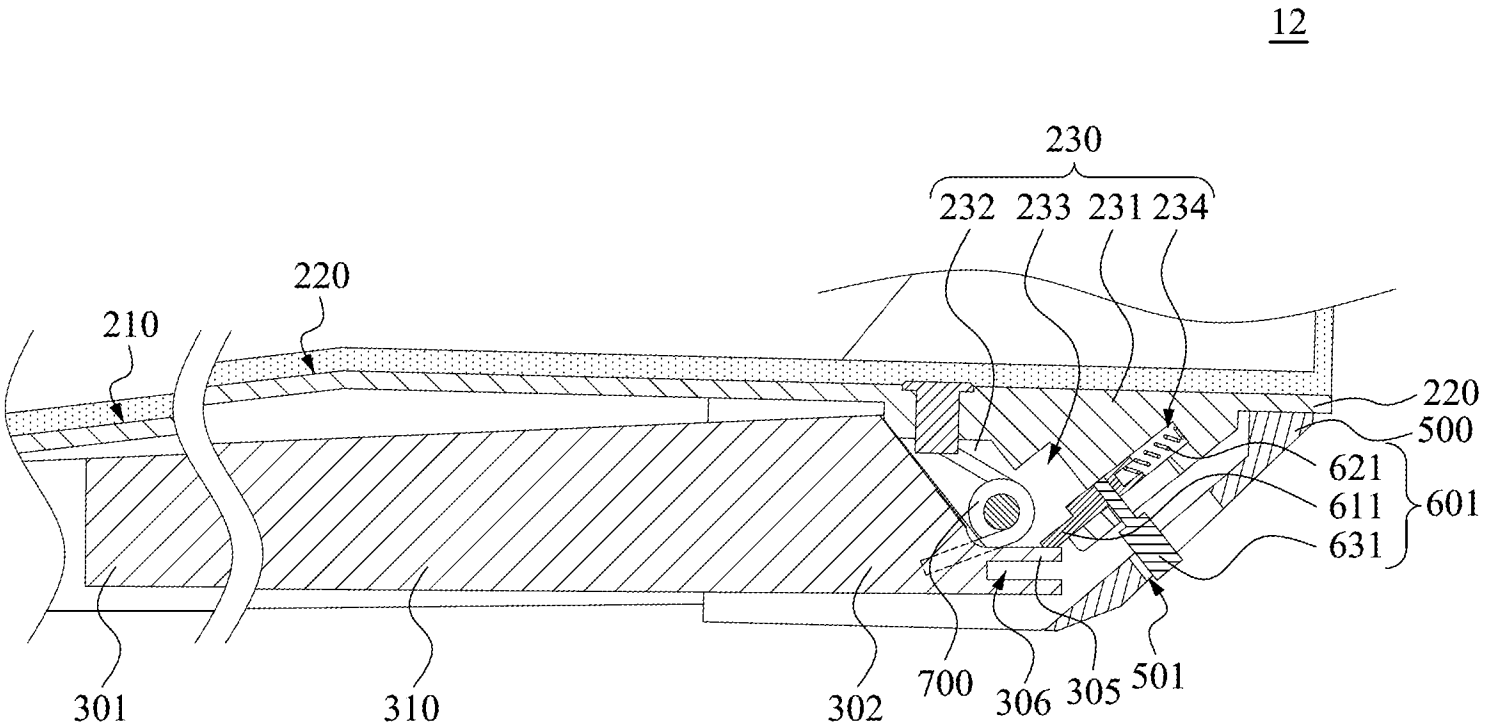
FIG. 9A depicts a partial cross-sectional view of a shoe capable of changing shoe types in a flat shoe model according to one embodiment of the disclosure, whose sectional direction is the same as the sectional direction in FIG. 3.
Figure 9B:
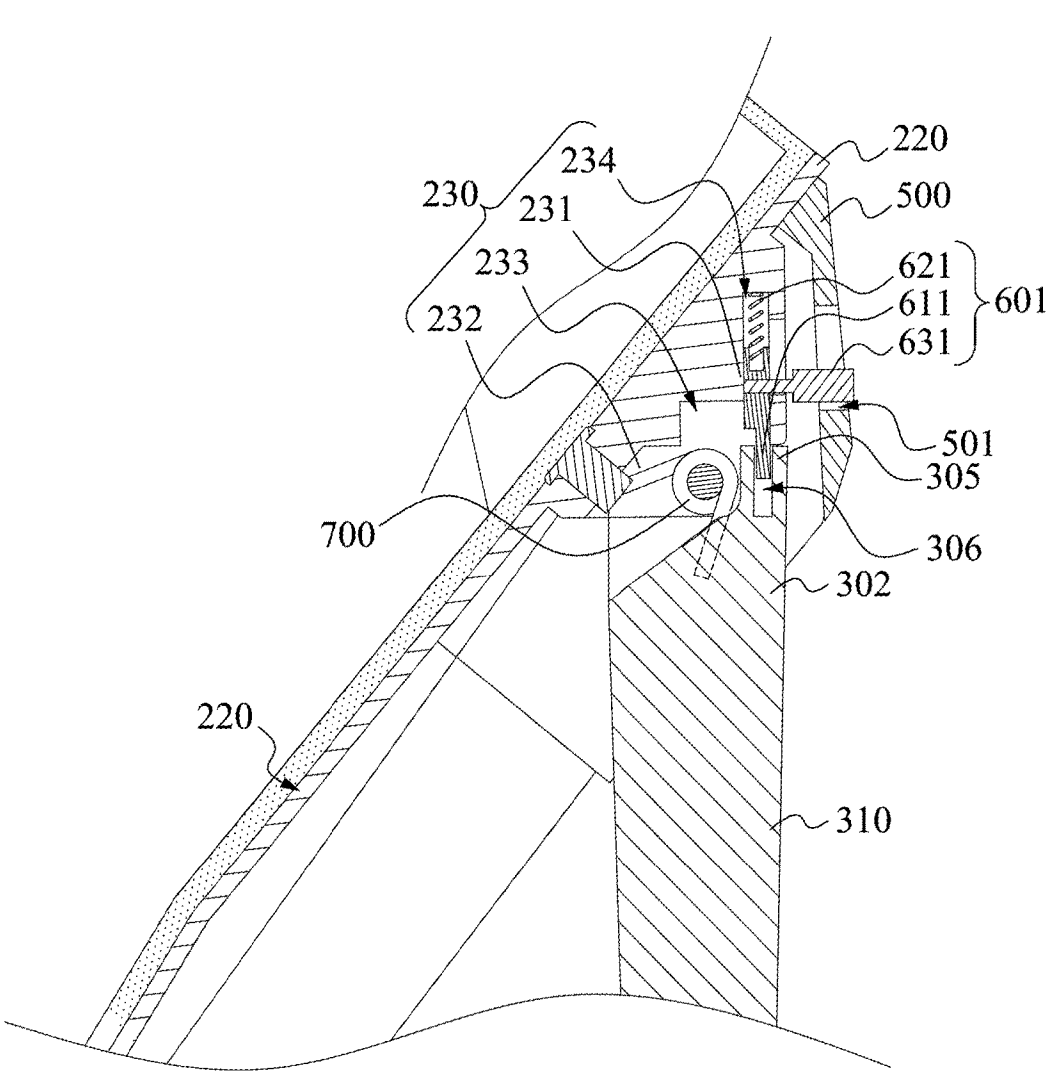
FIG. 9B depicts a partial cross-sectional view of the shoe of FIG. 9A in a heel shoe model.

FIG. 9A depicts a partial cross-sectional view of a shoe 12 capable of changing shoe types in a flat shoe model according to one embodiment of the disclosure, whose sectional direction is the same as the sectional direction in FIG. 3. FIG. 9B depicts a partial cross-sectional view of the shoe 12 of FIG. 9A in a heel shoe model. As shown in FIG. 9A and FIG. 3, the shoe 12 in FIG. 9A and the shoe 10 in FIG. 3 are substantially the same, except that the latch mechanism 601 in FIG. 9A is installed on the pivoting base 230 rather than the shoe heel 300.

More specifically, the latch mechanism 601 includes a second stopper 611, a second spring 621 and a second operation portion 631. The second stopper 611 is slidably disposed on the pivoting base 230, for example, the second stopper 611 is disposed within a space slot 234 formed on the pivoting base 230, and one end of the second stopper 611 extends outwards from the space slot 234. The second spring 621 is connected to the second stopper 611 and the pivoting base 230, and is able to force the second stopper 611 back to an original position of the second stopper 611. For example, the second spring 621 is disposed within the space slot 234, and one end of the second spring 621 abuts against an inner wall of the space slot 234, and the opposite end of the second spring 621 abuts against the second stopper 611. The second operation portion 631 is connected to the second stopper 611, and is able to be moved along with the second stopper 611. The second operation portion 631 is exposed outwards from the shoe 12 through the shoe sole layer 500. For example, the second operation portion 631 is a push button or a lever, and the second operation portion 631 is exposed outwards from a break 501 of the shoe sole layer 500. The break 501 is formed on one side of the shoe sole layer 500 adjacent to the rear bracket 220.

Thus, as shown in FIG. 9A, when the second spring 621 forces the second stopper 611 back to the aforementioned original position to abut an outer surface of the shoe heel 300, at this moment, the second stopper 611 abuts a protrusion 305 protruding from the second end 302 of the shoe heel 300 so as to stop the shoe heel 300 from rotating outwards from the receiving recess 510, so as to keep the shoe 10 in the flat shoe model. Therefore, if a user moves the second stopper 611 away from the shoe heel 300 by moving the second operation portion 631 in the flat shoe model, the second stopper 611 releases the confinement of the shoe heel 300 so that the shoe heel 300 is free to be moved by the torsion spring 700 so as to transform the shoe 12 to the heel shoe model (FIG. 9B). At the moment, when the second spring 621 forces the second stopper 611 back to the aforementioned original position, the second stopper 611 exactly inserts into the concave trench 306 formed on the protrusion 305 and abuts against the inner surface of the concave trench 306 of the shoe heel 300, thus, the second stopper 611 stops the shoe heel 300 from rotating so as to keep the shoe 12 in the heel shoe model.

Figure 10A:
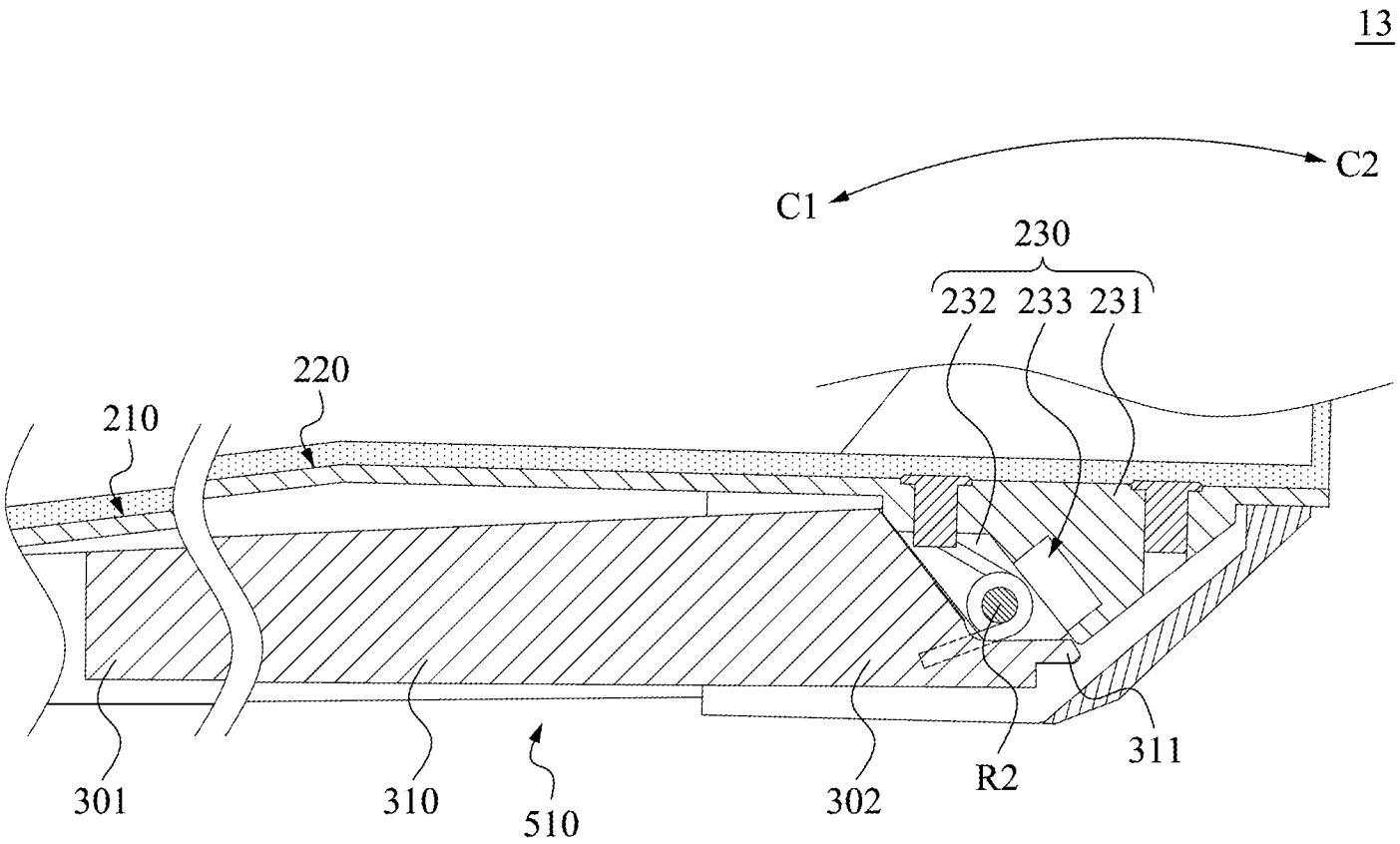
FIG. 10A depicts a partial cross-sectional view of a shoe capable of changing shoe types in a flat shoe model according to one embodiment of the disclosure, whose sectional direction is the same as the sectional direction in FIG. 3.
Figure 10B:
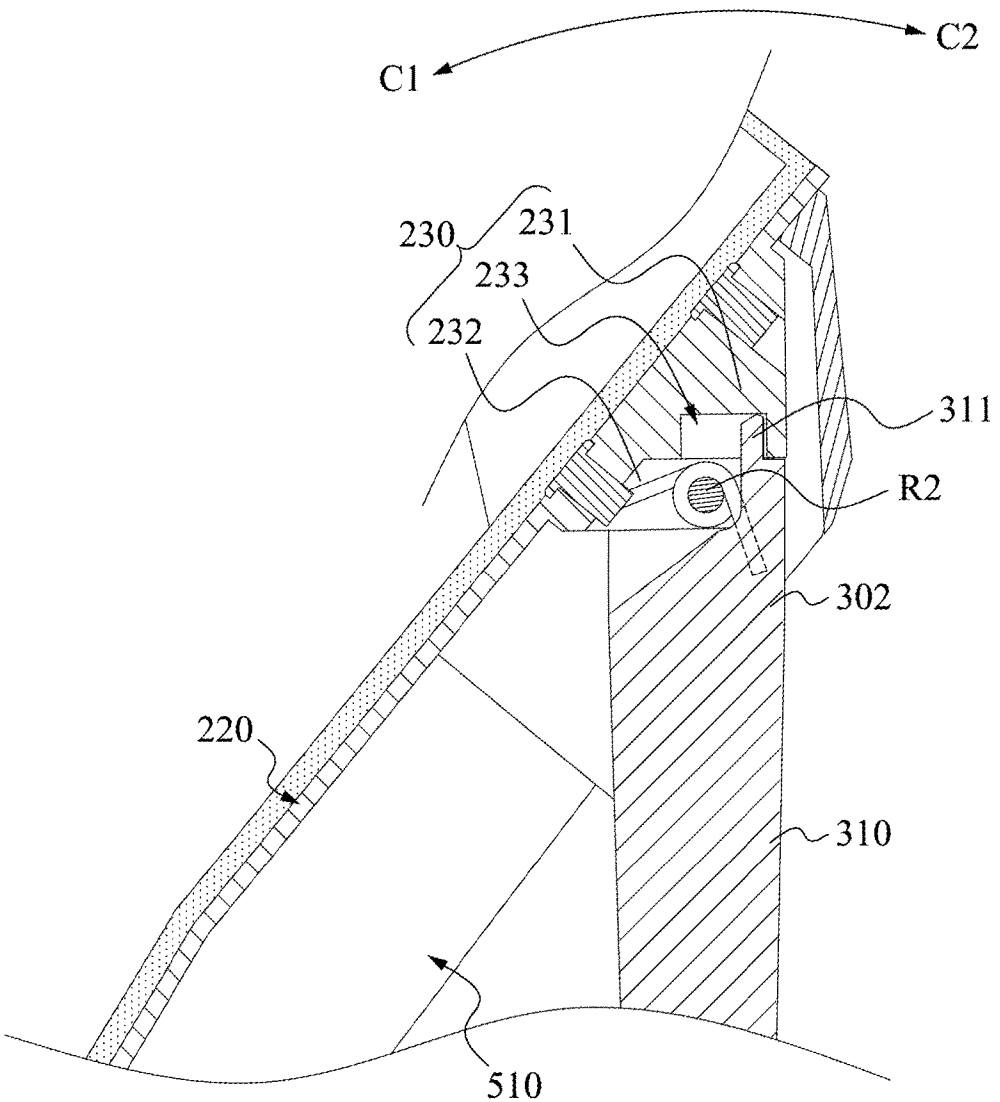
FIG. 10B depicts a partial cross-sectional view of the shoe of FIG. 10A in a heel shoe model.

FIG. 10A depicts a partial cross-sectional view of a shoe 13 capable of changing shoe types in a flat shoe model according to one embodiment of the disclosure, whose sectional direction is the same as the sectional direction in FIG. 3, and FIG. 10B depicts a partial cross-sectional view of the shoe 13 of FIG. 10A in a heel shoe model. As shown in FIG. 10A and FIG. 3, the shoe 13 in FIG. 10A and the shoe 10 in FIG. 3 are substantially the same, except that the latch mechanism in FIG. 10A only has an elastic rib 311 rather than the stopper, the spring and the operation portion mentioned above. The elastic rib 311 is fixedly provided on the second end 302 of the shoe heel 310, extends towards a direction opposite to the first end 301 of the shoe heel 310. For example, the elastic rib 311 is monolithically formed on the second end 302 of the shoe heel 310.

Therefore, refer to FIG. 10A and FIG. 10B following an order from FIG. 10A to FIG. 10B, the elastic rib 311 can be temporarily deformed to be moved to an inner surface of the inner cavity 233, on the contrary, refer to FIG. 10A and FIG. 10B following an order from FIG. 10B to FIG. 10A, the elastic rib 311 can be temporarily deformed to be moved to an outer surface of the pivoting base 230, so that the outer surface of the pivoting base 230 abuts against the elastic rib 311 for stopping the shoe heel 310 from rotating in the first direction C1 opposite to the second direction C2.

Thus, refer to FIG. 10A and FIG. 10B, when the user exerts enough strengths to rotate the rear bracket 220 for rotating the shoe heel 310 outwards from the receiving recess 510, since the elastic rib 311 is a rib with flexibility, the elastic rib 311 can be temporarily deformed for moving into the inner cavity 233. Thus, the shoe heel 310 confined in the receiving recess 510 does not need to be released by the user's hand completely for transforming the shoe 13 to the heel shoe model. At this moment, as shown in FIG. 10B, the inner surface of the inner cavity 233 abuts against the elastic rib 311 for stopping the shoe heel 310 from rotating in the second direction C2. On the contrary, when the user exerts enough strength to press the shoe heel 310 to rotate into the receiving recess 510, equally, since the elastic rib 311 is a rib with flexibility, the elastic rib 311 can be temporarily deformed for moving outwards from the inner cavity 233. Thus, the shoe heel 310 confined in the inner cavity 233 does not need to be released by the user's hand completely for transforming the shoe 13 to the flat shoe model. At this moment, as shown in FIG. 10A, the outer surface of the pivoting base 230 abuts against the elastic rib 311 for stopping the shoe heel 310 from rotating in the first direction C1.

Figure 11A:
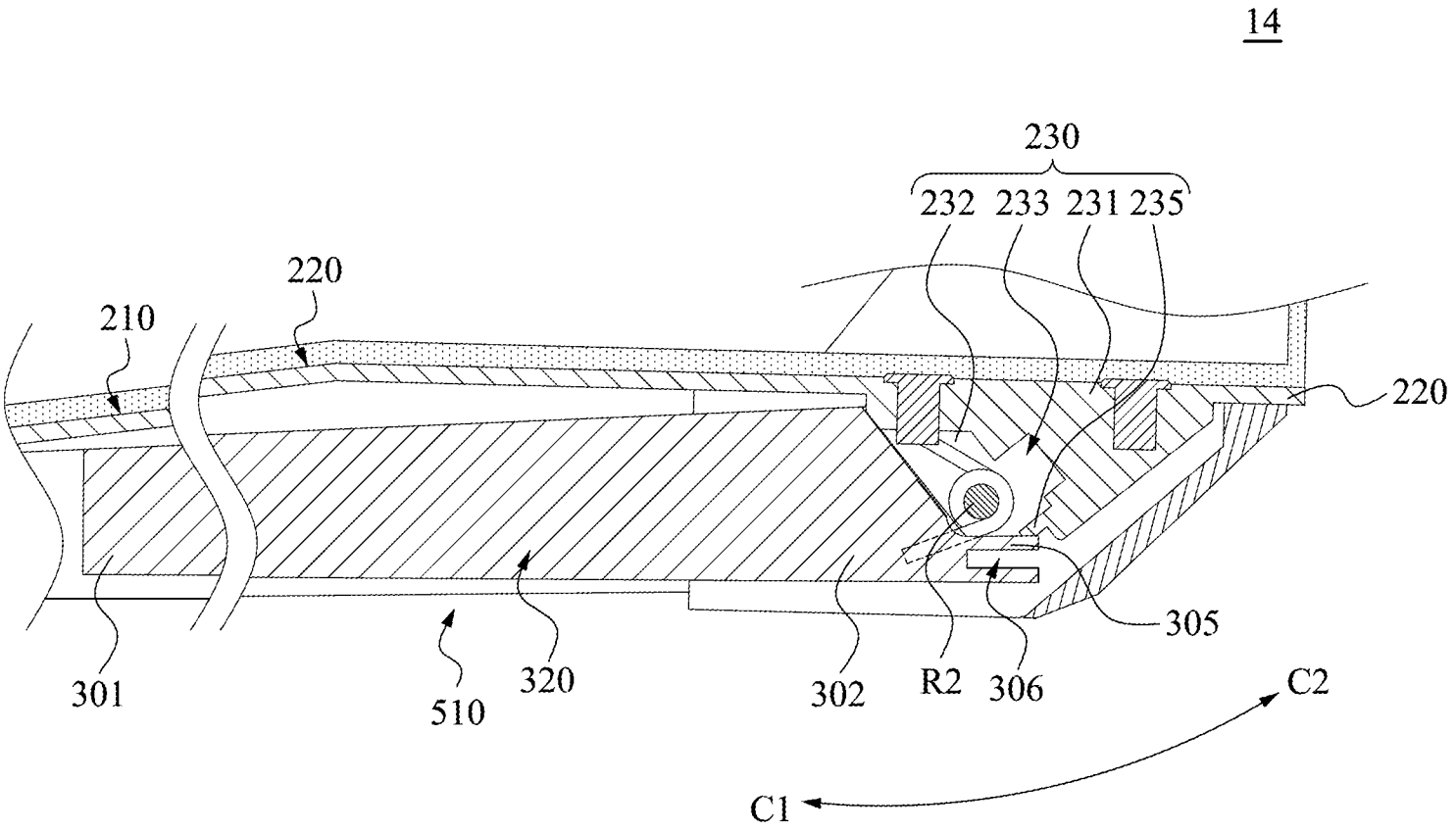
FIG. 11A depicts a partial cross-sectional view of a shoe capable of changing shoe types in a flat shoe model according to one embodiment of the disclosure, whose sectional direction is the same as the sectional direction in FIG. 3.
Figure 11B:
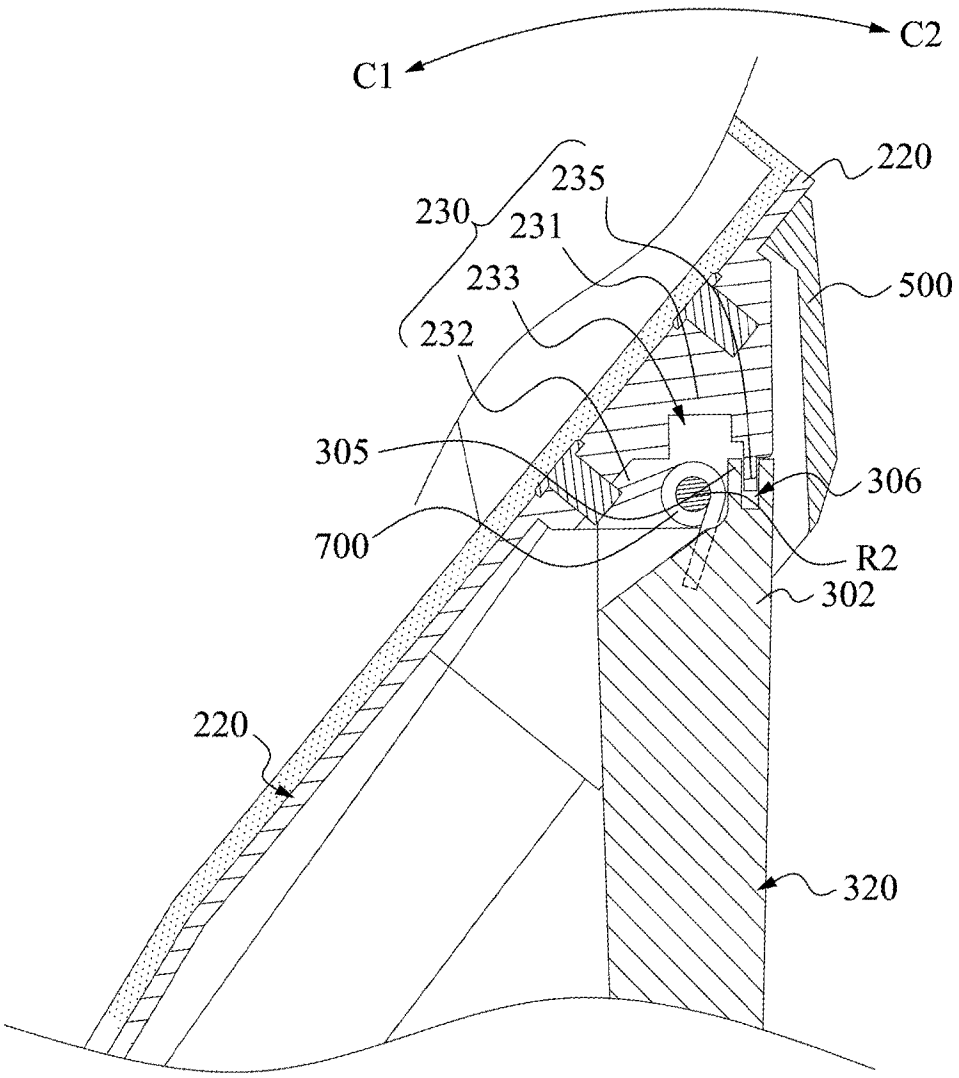
FIG. 11B depicts a partial cross-sectional view of the shoe of FIG. 11A in a heel shoe model.

FIG. 11A depicts a partial cross-sectional view of a shoe 14 capable of changing shoe types in a flat shoe model according to one embodiment of the disclosure, whose sectional direction is the same as the sectional direction in FIG. 3, and FIG. 11B depicts a partial cross-sectional view of the shoe 14 of FIG. 11A in a heel shoe model. As shown in FIG. 11A and FIG. 3, the shoe 14 in FIG. 11A and the shoe 10 in FIG. 3 are substantially the same, except that the elastic rib 235 in FIG. 11A is connected to the pivoting base 230 rather than the shoe heel 320, and the elastic rib 235 in FIG. 11A is fixedly connected to one end of the pivoting base 230, extended towards the shoe heel 320. For example, the elastic rib 235 is monolithically formed on the one end of the shoe heel 320.

Therefore, when the elastic rib 235 is temporarily deformed for moving to the outer surface of protrusion 305 of the shoe heel 320, the elastic rib 235 abuts against the outer surface of protrusion 305 of the shoe heel 320 so as to stop the shoe heel 320 from rotating towards the second direction C2; on the contrary, when the elastic rib 235 is temporarily deformed for moving into the concave trench 306 formed on the protrusion 305 of the shoe heel 320, the inner surface of the concave trench 306 abuts against the elastic rib 235 so as to stop the shoe heel 320 from rotating towards the first direction C1.

It is noted, the number of the shoe heel 300, the linking member 400, the front bracket 210, the rear bracket 220, the first to fourth pivots R1-R4, the pivoting base 230, the latch mechanism 600, and the elastic ribs 311 illustrated above are only exemplary, not for limitations to the disclosure. One with ordinary skill in the field of the disclosure may adjust the number of the aforementioned elements according to the actual requirements.

Furthermore, as long as the shoe heel can support the heel part of the human foot under the shoe after rotating out of the receiving recess, the shoe heel mentioned in the disclosure is not limited to any outlines or functions of a support. The support for example is a non-shoe heel (e.g., an auxiliary wheel or a shoe spike) are within the scope of the disclosure as claimed.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A shoe capable of changing shoe types, characterized by comprising:

a shoe body;

a shoe loading-plate disposed on one side of the shoe body, comprising a front bracket and a rear bracket pivotally connected to one end of the front bracket with a first pivot, and the rear bracket having a pivoting base that is formed on one side of the rear bracket opposite to the shoe body and the front bracket that is formed with a lug protruding from the end of the front bracket towards the pivoting base;

a shoe heel in which one end of the shoe heel is pivotally connected to the pivoting base with a second pivot;

a linking member disposed on the side of the rear bracket opposite to the shoe body, and pivotally connected to the front bracket and the shoe heel, the linking member comprising an elongated slab, a first opening and a second opening, wherein one end of the elongated slab is pivotally connected to the lug with a third pivot, and the other end of the elongated slab is pivotally connected to the shoe heel with a fourth pivot, the first opening is formed on the end of the elongated slab for receiving the lug, and the second opening is formed on the other end of the elongated slab with an elongated shape; and a shoe sole layer covering the shoe loading-plate and the linking member, having a receiving recess that is formed on one surface of the shoe sole layer opposite to the shoe body and in communication with the second opening, wherein the rear bracket is able to rotate in relation to the front bracket in accordance with the first pivot, the shoe heel is able to rotate in relation to the rear bracket in accordance with the second pivot, one end of the elongated slab is able to rotate in relation to the front bracket in accordance with the third pivot, and the other end of the elongated slab is able to rotate in relation to the shoe heel in accordance with the fourth pivot, and the first pivot, the second pivot, the third pivot and the fourth pivot are parallel one another, and the fourth pivot is located between the second pivot and the rear bracket, wherein, when the shoe heel is folded to the shoe sole layer, the shoe heel is able to be received in the second opening of the linking member via the receiving recess.

2. The shoe capable of changing shoe types of claim 1, further comprising:

a resilient element connected to the shoe loading-plate and the shoe heel, for moving the shoe heel to rotate out of the receiving recess, or moving the shoe heel to rotate into the receiving recess.

3. The shoe capable of changing shoe types of claim 1, further comprising:

a latch mechanism connected to at least one of the shoe heel and the pivoting base, for locking the shoe heel in and out of the receiving recess.

4. The shoe capable of changing shoe types of claim 3, wherein the latch mechanism comprises:

a stopper slidably disposed on the shoe heel;

a spring connected to the stopper and the shoe heel, for returning the stopper back to an original position of the stopper; and an operation portion connected to the stopper, and exposed outwards from the shoe through the receiving recess, wherein, when the stopper abuts against the pivoting base, the pivoting base stops the shoe heel from rotating, when the operation portion moves the stopper away from the pivoting base, the shoe heel is free to rotate.

5. The shoe capable of changing shoe types of claim 3, wherein one surface of the pivoting base is formed with an inner cavity, the latch mechanism further comprises an elastic rib, the elastic rib is monolithically formed on the one end of the shoe heel, wherein, when the elastic rib is temporarily deformed to be moved out of the inner cavity, an outer surface of the pivoting base abuts against the elastic rib for stopping the shoe heel from rotating in a first direction, when the elastic rib is temporarily deformed to be moved into the inner cavity, an inner surface of the inner cavity abuts against the elastic rib for stopping the shoe heel from rotating in a second direction opposite to the first direction.

6. The shoe capable of changing shoe types of claim 3, wherein the latch mechanism comprises:

a stopper slidably disposed on the pivoting base;

a spring connected to the stopper and the shoe heel, for returning the stopper back to an original position of the stopper; and an operation portion connected to the stopper, and exposed outwards from the shoe through one side of the shoe sole layer adjacent to the rear bracket, wherein, when the stopper abuts against the shoe heel, the stopper stops the shoe heel from rotating, when the operation portion moves the stopper away from the shoe heel, the shoe heel is free to rotate.

7. The shoe capable of changing shoe types of claim 3, wherein the one end of the shoe heel is formed with a concave trench, the latch mechanism further comprises an elastic rib, the elastic rib is monolithically formed on the one end of the pivoting base, wherein, when the elastic rib is temporarily deformed to be moved to an outer surface of the concave trench from the concave trench, the elastic rib abuts against the one end of the shoe heel for stopping the shoe heel from rotating in a first direction, when the elastic rib is temporarily deformed to be moved into the concave trench, an inner surface of the concave trench abuts against the elastic rib for stopping the shoe heel from rotating in a second direction opposite to the first direction.

8. The shoe capable of changing shoe types of claim 1, wherein another end of the shoe heel is a free end, and the free end of the shoe heel is in physical contact with the shoe sole layer in the receiving recess.

9. A shoe capable of changing shoe types, characterized by comprising:

a shoe body;

a shoe sole layer formed with a receiving recess on one surface of the shoe sole layer opposite to the shoe body; and a four-bar linkage assembly disposed between the shoe body and the shoe sole layer, and the four-bar linkage assembly comprising a front bracket, a rear bracket, a support and a linking member having an elongated slab and an elongated opening formed on one end of the elongated slab in the receiving recess, wherein the front bracket is pivotally connected to the rear bracket with a first pivot, and the end of support is disposed in the elongated opening, and one end of the support is pivotally connected to the linking member with a fourth pivot, and the end of the support is pivotally connected to the rear bracket with a second pivot, wherein the rear bracket is able to rotate in relation to the front bracket in accordance with the first pivot, the shoe heel is able to rotate in relation to the rear bracket in accordance with the second pivot, one end of the elongated slab is able to rotate in relation to the front bracket in accordance with the third pivot, and the other end of the elongated slab is able to rotate in relation to the shoe heel in accordance with the fourth pivot, and the first pivot, the second pivot, the third pivot and the fourth pivot are parallel one another, and the fourth pivot is located between the second pivot and the rear bracket, wherein, when the rear bracket is rotated to narrow an included angle defined between the front bracket and the rear bracket, the support member is moved out of the elongated opening via the receiving recess by the linkage of the rear bracket and the linking member.

10. The shoe capable of changing shoe types of claim 9, further comprising:

a resilient element connected to the rear bracket and the support, for moving the support to rotate out of the receiving recess, or moving the support to rotate into the receiving recess.

11. The shoe capable of changing shoe types of claim 9, further comprising:

a latch mechanism connected to at least one of the support and the rear bracket, for locking the support in and out of the receiving recess.

12. The shoe capable of changing shoe types of claim 11, wherein the latch mechanism comprises:

a stopper slidably disposed on the support;

a spring connected to the stopper and the support, for returning the stopper back to an original position of the stopper; and an operation portion connected to the stopper, and exposed outwards from the shoe through the receiving recess, wherein, when the stopper abuts against the rear bracket, the rear bracket stops the support from rotating, when the operation portion moves the stopper away from the rear bracket, the support is free to rotate.

13. The shoe capable of changing shoe types of claim 11, wherein one surface of the rear bracket opposite to the shoe body further comprises an inner cavity, the latch mechanism further comprises an elastic rib, the elastic rib is monolithically formed on the one end of the support, wherein, when the elastic rib is temporarily deformed to be moved out of the inner cavity, the rear bracket abuts against the elastic rib for stopping the support from rotating in a first direction, when the elastic rib is temporarily deformed to be moved into the inner cavity, an inner surface of the inner cavity abuts against the elastic rib for stopping the support from rotating in a second direction opposite to the first direction.

14. The shoe capable of changing shoe types of claim 11, wherein the latch mechanism comprises:

a stopper slidably disposed on one side of the rear bracket opposite to the shoe body;

a spring connected to the stopper and the rear bracket, for returning the stopper back to an original position of the stopper; and an operation portion connected to the stopper, and exposed outwards from the shoe through one side of the shoe sole layer adjacent to the rear bracket, wherein, when the stopper abuts against the support, the stopper stops the support from rotating, when the operation portion moves the stopper away from the support, the support is free to rotate.

15. The shoe capable of changing shoe types of claim 11, wherein the one end of the support is formed with a concave trench, the latch mechanism further comprises an elastic rib, the elastic rib is monolithically formed on one side of the rear bracket opposite to the shoe body, wherein, when the elastic rib is temporarily deformed to be moved to an outer surface of the concave trench from the concave trench, the elastic rib abuts against the one end of the support for stopping the support from rotating in a first direction, when the elastic rib is temporarily deformed to be moved into the concave trench, an inner surface of the concave trench abuts against the elastic rib for stopping the support from rotating in a second direction opposite to the first direction.

16. The shoe capable of changing shoe types of claim 9, wherein another end of the support is a free end, and the free end of the support is in physical contact with the shoe sole layer in the receiving recess.

17. The shoe capable of changing shoe types of claim 9, wherein the support is a shoe heel, an auxiliary wheel or a shoe spike.

* * * * *